US012617594B2

(12) United States Patent
Stack, Jr.

(10) Patent No.: US 12,617,594 B2
(45) Date of Patent: May 5, 2026

(54) MAIL PACKAGING HAVING EXPANDABLE SECURING FIXATIVE PLATFORM PANEL

(71) Applicant: Hexpand Technologies LLC, Waterbury, CT (US)

(72) Inventor: Steven Michael Stack, Jr., Torrington, CT (US)

( * ) Notice: Subject to any disclaimer, the term of this patent is extended or adjusted under 35 U.S.C. 154(b) by 91 days.

(21) Appl. No.: 18/830,536

(22) Filed: Sep. 10, 2024

(65) Prior Publication Data

US 2026/0070721 A1 Mar. 12, 2026

(51) Int. Cl.
*B65D 71/12* (2006.01)

(52) U.S. Cl.
CPC .... *B65D 71/12* (2013.01); *B65D 2571/00141* (2013.01); *B65D 2571/0016* (2013.01); *B65D 2571/0066* (2013.01)

(58) Field of Classification Search
CPC ..... B65D 71/12; B65D 2571/00141; B65D 2571/0016; B65D 2571/0066; B65D 5/48048; B65D 5/50; B65D 5/5035; B65D 5/5021; B65D 81/07; B65D 5/22; B65D 5/6664; B65D 65/24; B65D 2251/1033; B65D 5/5038; B65D 5/5213
USPC ..... 229/198.2, 120.38, 120.21, 906, 120.32, 229/164, 120, 147, 149, 152, 154, 178, 229/199, 232; 206/478, 583, 462, 488, 206/461, 471; 220/4.23
See application file for complete search history.

(56) References Cited

U.S. PATENT DOCUMENTS

| | | | | |
|---|---|---|---|---|
| 3,246,747 | A * | 4/1966 | Blish | B65D 73/0092 206/469 |
| 3,908,827 | A * | 9/1975 | Bemmels | B65D 73/005 206/478 |
| 10,676,233 | B2 * | 6/2020 | Wolf | B65D 5/0085 |
| 11,414,247 | B1 * | 8/2022 | Philips | B65D 43/24 |
| 2004/0040880 | A1 * | 3/2004 | Grosskopf | B65D 83/0445 220/4.23 |
| 2011/0024324 | A1 * | 2/2011 | Tanner | B65D 81/075 206/588 |
| 2015/0314936 | A1 * | 11/2015 | Stack, Jr. | B65D 81/075 206/488 |

FOREIGN PATENT DOCUMENTS

| | | |
|---|---|---|
| CN | 211494855 U | 9/2020 |
| KR | 102241173 B1 | 4/2021 |

* cited by examiner

*Primary Examiner* — Christopher R Demeree
(74) *Attorney, Agent, or Firm* — Wasserbauer Law, LLC; Damian G. Wasserbauer, Esq.; Nicholas E. Blanton, Esq.

(57) ABSTRACT

A container for containing at least one article. The container being formed from a blank having connected panels in a predetermined pattern that when erected can form at form an interior of the container. The container comprises an expandable slit pattern feature on the fixative platform panel for protecting the articles from breakage. The fixative platform panel further features one or more protuberances on a folded edge thereof for securing in an opening formed by a slot and protuberance notch in the second and third side panels of the container. The container further features one or more flaps having protrusion(s) on an outer edge of the blank for securing in one or more slots in the bottom panel of the container.

7 Claims, 6 Drawing Sheets

MAIL PACKAGING HAVING EXPANDABLE SECURING FIXATIVE PLATFORM PANEL

FIELD OF THE INVENTION

The invention relates generally to a packaging article and the method of manufacture thereof, and more specifically to a container such as an economical mailer pack formed from a single panel of corrugated cardboard having a fixative panel with an expandable predetermined slit pattern for securing at least one item or object within the container by folding the fixative panel over the object thereby holding it and folding a top panel with wrap around end flap over the container with the object therein.

BACKGROUND OF THE INVENTION

Conventional corrugated cardboard terminology uses corrugated board made from material consisting of one or more layers of fluted paper, usually referred to as medium, sandwiched between flat linerboard sheets to a panel having strength and cushioning properties. Conventional corrugated cardboard box designs and styles form a box blank consisting of a flat sheet of corrugated board that has been cut, scored and slotted to permit folding, and/or perforated, but not yet assembled. Cutting further provides for flaps that extend from the side and end panels form the top and bottom of the box with the two outer flaps are one-half the container's width to meet at the center of the box when folded; and the two outer flaps are one-half the container's width in order to meet at the center of the box when folded.

A common box style is a regular slotted container (RSC) made from a single sheet of corrugated that has been scored and slotted to allow for folding. Flute direction may be perpendicular to the length of the sheet for top-opening RSCs, or parallel to the length of the sheet for end-opening RSCs. Some other designs include a manufacturer's joint where an area where the ends of a box blank are fastened together, usually with glue, tape, or staples; although, use of a manufacturer's joint has disadvantages for smaller boxes due to additional assembly, glue, tape, staples, or other materials increasing assembly time and the cost. Consequently, there is still a need for improvements in foldable containers formed from a flat blank to secure items from movement in shipment that overcome problems of material cost and manufacturing waste, ease of assembly, and recycling the packaging.

The present invention is directed to jointless slotted containers and/or improvements to a container formed from a single panel of corrugated cardboard having an integral fixative platform panel with an expandable slit pattern adapted to hold an object in predetermined cut pattern in a predetermined slit pattern configured to expand and hold an object in a foldable mailing box.

SUMMARY OF THE INVENTION

Generally, one aspect of the disclosure is directed to a container for containing at least one article having at least one side panel having a fixative platform panel fold ably connected to the container.

Another aspect of the disclosure is generally directed to a flat blank for forming a container for containing at least one article having a fixative platform panel foldably connected to the container.

In addition, another aspect of the disclosure is generally direct to a method of forming a container in a predetermined pattern by making cuts, slots, scoring, and perforations in the flat blank using packaging machinery for a blank comprising at least one side panel having fixative platform panel foldably connected to the container.

BRIEF DESCRIPTION OF THE DRAWINGS

Non-limiting and non-exhaustive embodiments of the present invention are described with reference to the following drawings. In the drawings, like numerals describe like components throughout the several views.

For a better understanding of the present invention, reference will be made to the following detailed description, which is to be read in association with the accompanying drawings, which are incorporated in and constitute a part of this specification, show certain aspects of the subject matter disclosed herein, and, together with the description, help explain some of the principles associated with the disclosed implementations, wherein.

DESCRIPTION OF THE EMBODIMENTS

Figure 1:
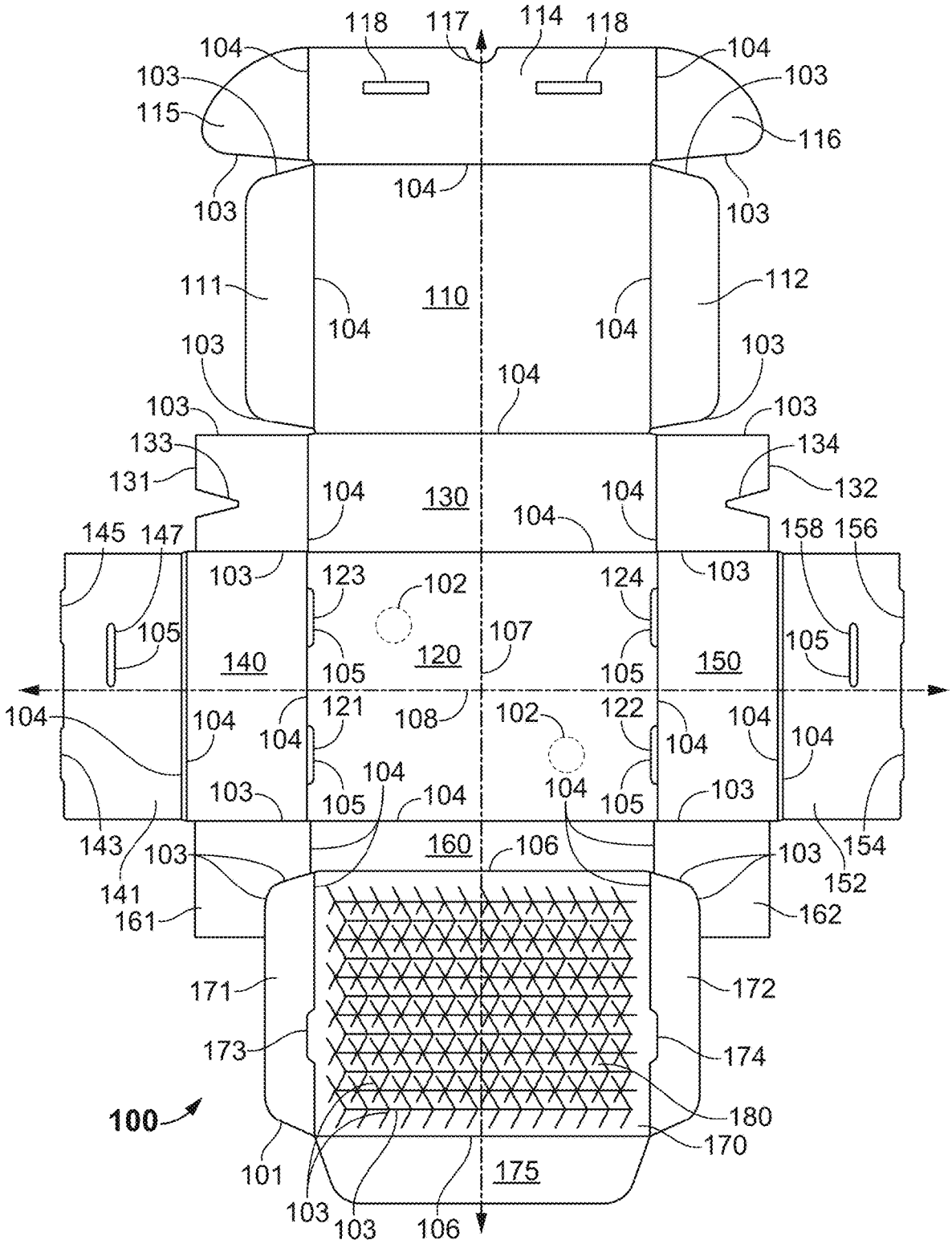
FIG. 1 is a plan view of an exterior surface of a blank for forming a container according to a first embodiment of the disclosure.
Figure 2:
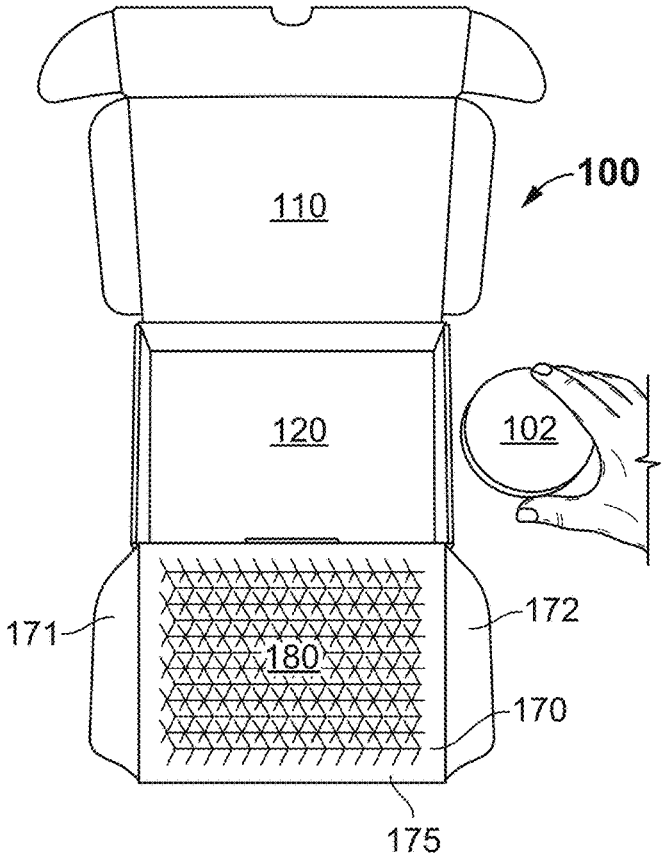
FIG. 2 is a schematic perspective views of the partially assembled container thereof.
Figure 3:
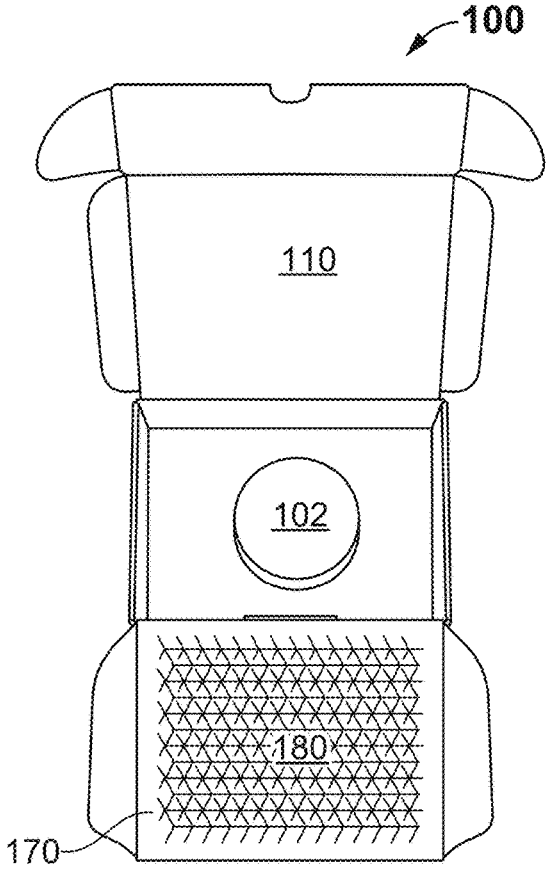
FIG. 3 is a schematic perspective view of the partially assembled container FIG. 2 with articles added to the partially assembled container.

Non-limiting embodiments of the invention will be described below with reference to the accompanying drawings, wherein like reference numerals represent like elements throughout. While the invention has been described in detail with respect to the preferred embodiments thereof, it will be appreciated that upon reading and understanding of the foregoing, certain variations to the preferred embodiments will become apparent, which variations are nonetheless within the spirit and scope of the invention. The drawings featured in the figures are provided for the purposes of illustrating some embodiments of the invention and are not to be considered as limitation thereto.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "some embodiments", "one embodiment", "certain embodiments", and "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means any of the following: "A; B; C; A and B; A and C; B and C; A, B and C". An exception to this definition will occur only when a combination of elements, functions, steps or acts are in some way inherently mutually exclusive.

The drawings featured in the figures are provided for the purposes of illustrating some embodiments of the present invention and are not to be considered as limitation thereto. The term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein and use of the term "means" is not intended to be limiting. The term "cut" or "cutting" is a process of shearing through the corrugated material to create the desired box shape usually performed by a metal die to cut custom shapes or designs into the corrugated material to create a predetermined pattern; and "slits" are cuts in the blank not separating one panel from another. The term "score" or "scoring" involves making an impression or crease in the board to facilitate bending or folding Making, and "crease" or "creasing", like scoring, involves making a compressed line in the board to allow for precise folding. The term "slot" or "slotting" involves cutting specific slots in the board, often used to create flaps, tabs, and/or other strips. The term "perforate" or "perforating" involves creating a series of small cuts or punctures in the board such as, for example, to allow for easy bending, folding, or tearing along a specific line. The term "lid," "cover," or "top" refers to a removable or attached "top" for a container or box to enclose the contents. The term "bottom" or "base" refers to the base piece of the package that typically contains items and/or objects. The term "flap" or "tab" refers to an extension of the sidewall panels that, when sealed, close the remaining openings of a box, usually defined by one scoreline and three edges. The term "hinge" refers to a component that attaches two pieces of the package together but allow movement of one or both pieces along its axis in two directions.

The drawings, including FIGS. 1 through 12, may contain sizes and shapes of respective portions that are appropriately exaggerated for ease of understanding. A box, container, or pack according to the disclosure can accommodate items and/or objects of any shape. For the purpose of illustration and not for the purpose of limiting the scope of the disclosure, the following detailed description describes a mailer pack for holding items and/or object as disposed within the container. In this specification, the terms, and variations thereof, of "downward," "upward," "lower," "bottom," "upper" and "top" indicate orientations determined in relation to fully erected and upright container. Additionally, like or similar features will be indicated with like or similar reference numbers. Accordingly, the comparative sizes and/or shapes displayed in the drawings should be considered non-limiting.

According to an embodiment of the invention, FIG. 1 is a plan view of the container, generally indicated at 100, showing the exterior of a blank 101 used to form the container 100 as formed from a single panel of corrugated cardboard die cut, slotted, scored, creased, and/or perforated into a predefined pattern according to an embodiment of the disclosure. The blank 101 comprises lines for one or more cuts 103, scores 104, slots 105, and perforations 106 along its longitudinal axis 107 and lateral axis 108 as shown in FIG. 1. The container 100 can be used to house a plurality of articles, items or objects 102 such as, for example, items or objects of value for safely shipping and/or return. In the illustrated embodiment, the container 100 is sized to receive one or more item(s) 102 in a single layer, but it is understood that the container 100 may be sized and shaped to hold more such as, for example, a different quantity in more than one layers and/or arrangements.

Referring to FIG. 1, the blank 101 has connected portions in a predetermined pattern that comprises a top panel 110, a bottom panel 120, a (first) connective side panel 130, a (second) side panel 140 with a flap 141 adapted to be secured by protrusion 143, 145, a (third) side panel 150 with a flap 152, and a (fourth) side panel 160 with a fixative platform panel 170 having an slit pattern 180 configured to be expandable. Each of the interconnected top panel 110, bottom panel 120, connective side panel 130, and side panels 140, 150 and 160, a fixative platform panel 170 with expandable slit pattern 180 are formed by one or more cut 103, score 104, slot 105, and/or perforation 106 oriented along respective lateral axis 107 and longitudinal axis 108 to provide the predetermined pattern for a blank 101. Similarly, cuts 103 and score lines 104 disposed on the blank 101 oriented along the lateral axis 108 allows for folding for each of the side support flaps 111 and 112, the side flaps 131 and 132, the side panel 140 and side panel flap 142, the side panel 150 and side panel flap 152, the side panel 160 and side panel flaps 161 and 162, and the side platform support flaps 171 and 173. The wrap around end flap 114 is configured with side tab 115 and side tab 116 and the wrap around end flap 114 and may be further configured with a notch 117.

The container 100 may be manufactured using modern package machinery for corrugate board, for example, machine die can be used to make in a predetermined pattern one or more cuts 103, slots 105, slits and perforations as well as other machinery may create be used to create creases, slits, score lines 104, and/or perforations 106 on the blank 101. As illustrated in FIG. 1, when viewed along the lateral axis 107 (top to bottom) of the blank 101, the container 100 of the present invention is formed by folding connected portions formed by the one or more cut 103, score 104, slot 105, and/or perforation 106. The blank 101 can be shipped flat and folded to assemble along each of the operatively connected top panel 110, (first) connective side panel 130, a bottom panel 120, (fourth) side panel 160, fixative platform panel 170, and perforations side platform support flap 175. Accordingly, like or similar features will be indicated with like or similar reference numbers.

Figure 10:
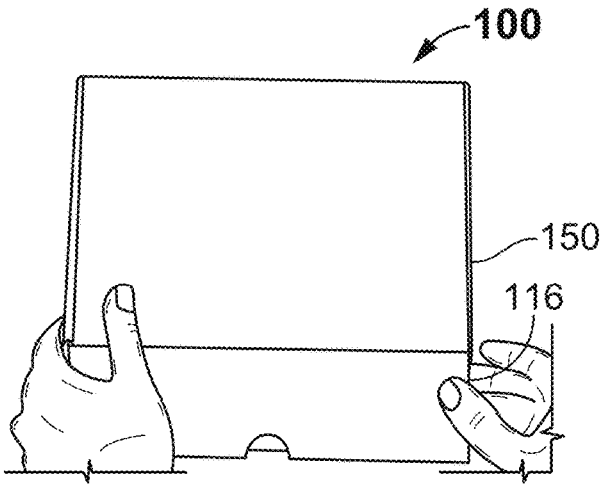
FIG. 10 is a view similar to FIG. 9 but showing the wrap around end flap side tab as further assembled.
Figure 11:
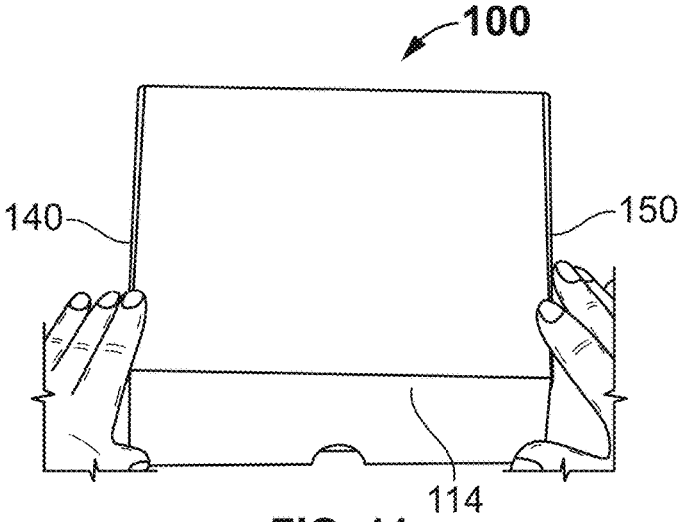
FIG. 11 is a view similar to FIG. 10 but showing the container as further assembled.
Figure 12:
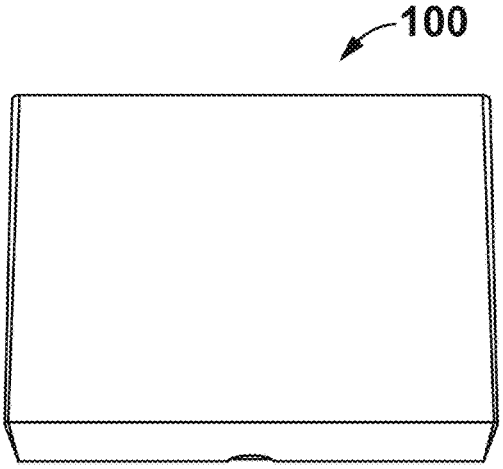
FIG. 12 is a view similar to FIG. 11 but showing the container fully assembled.

Also referring to FIG. 1, the top panel 110 is operatively connected to the wrap around end flap 114 due to the combination of cuts 103 adjacent the score line 104 forming side support flaps 111, 112 and side tabs 115, 116. The outer edge of the wrap around end flap 114 may be further configured with a notch 117 adapted to provide ease of opening of a closed, fully assembled container 110, e.g. use of a digit or user's finger to open. The wrap around end flap 114 is configured with side tab 115 and side tab 116 that are configured to be received the space provided between the side panel 140 and flap 141 as well as between the side panel 150 and flap 152 when the container 100 is assembled in a closed position, as shown in FIGS. 10-12. Advantageously, the wrap around end flap 114 may further include one or more adhesive portions 118, illustrated in FIG. 1, for sealing the container 100 such as, for example, use of an adhesive strip, double stick tape, glue, or the like to further seal the container 101.

The bottom panel 120 of the blank 101 is foldably connected to each of the: (first) connective side panel 130; (second) side panel 140 with a flap 141 adapted to be secured by protrusion 143, 145 in slot 121, 123, respectively; (third) side panel 150 with a flap 152 adapted to be secured by protrusion 152, 154 in slot 122, 124; and (fourth) side panel 160 joined by a perforation 106 to a fixative platform panel 170 having an slit pattern 180 configured to be expandable. One or more lines of perforation 106 can replace score 104 lines on the side platform support flap 175 a fixative platform panel 170 to allow for: folding of the one or more side platform support flaps 175 upwardly or downwardly, and/or for removal of the object by tearing thereof. The slit pattern 180 can be any suitable pattern of slits in the corrugate board that provide for expansion, fixation and/or securement of the object in the container such as, for example, a Y-shaped slits, triangle shaped slits, a Tessellation pattern, and others slits configured to be expandable and retain an object under tension.

Referring to FIGS. 2-12, in an embodiment of the invention, the fixative platform panel 170 is configured to secure, hold, and/or retain therein an item or object 102 between the upper surface of the bottom panel 120 and the lower surface of the fixative platform panel 170 using a predetermined slit pattern 180 configured to be expandable and roughly conform to the object 102 so that movement is minimized during shipment and/or otherwise use of the assembled container 100. For example, Referring to FIGS. 2-3, the object 102 can be placed within the base of an assembled open container 101, e.g. the assembled side wall structures of side panels 140, 141 and 132, 150, 152 folded over side flaps 131, 132 and side flaps 161, 162, thereby forming side walls with sufficient structural strength to withstand considerable multiple forces applied to the container 100 and object 102 within advantageously during assembly, expansion of the slit pattern in the at least one fixative platform panel, and for shipping. In assembly, shown in FIGS. 4-7, the expanded the slit pattern 180 conforms approximately to the object 102 after forces are placed on the fixative platform panel 170, which then stays in expanded form around the object by the upwardly extending side platform support flaps 171, 172, and 175, and/or the protuberances 171, 172 engaged in or pressed into slots 123, 124, respectively. The container 100 may be dimensioned advantageously to allow for multiple objects to be stacked in one container. 100 by adding a plurality of fixative platform panels 170.

For example, in FIG. 1, each fixative platform panel 170 can use a slot/notch connection arrangement in the side panels, e.g. aligning the one or more protuberances 173, 174 into the one or more slot(s) 147, 148 openings formed in flaps 141, 152 or other walls of an assembled container. The opening structure is further formed by protuberance notch 133 located between side panel 140 and flap 141 and aligned to the slot 147 to receive a side platform support flap 171. Similarly, protuberance 174 can be inserted into the slot 158 opening formed by protuberance notch 134 and/or flap 152. Further, in combination, the object 102 is held by the expanded slit pattern 180 by the side wall 160 being dimensioned less than the height dimension of the connective side panel 130, the side panel 140 and flap 141, and the side panel 150 and flap 152. Being dimensioned less than the side panels 130, 140, and 150 locates the fixative platform portion 170 at a height above the bottom panel 120 but less than the top panel 110 in a closed position.

Figure 4:
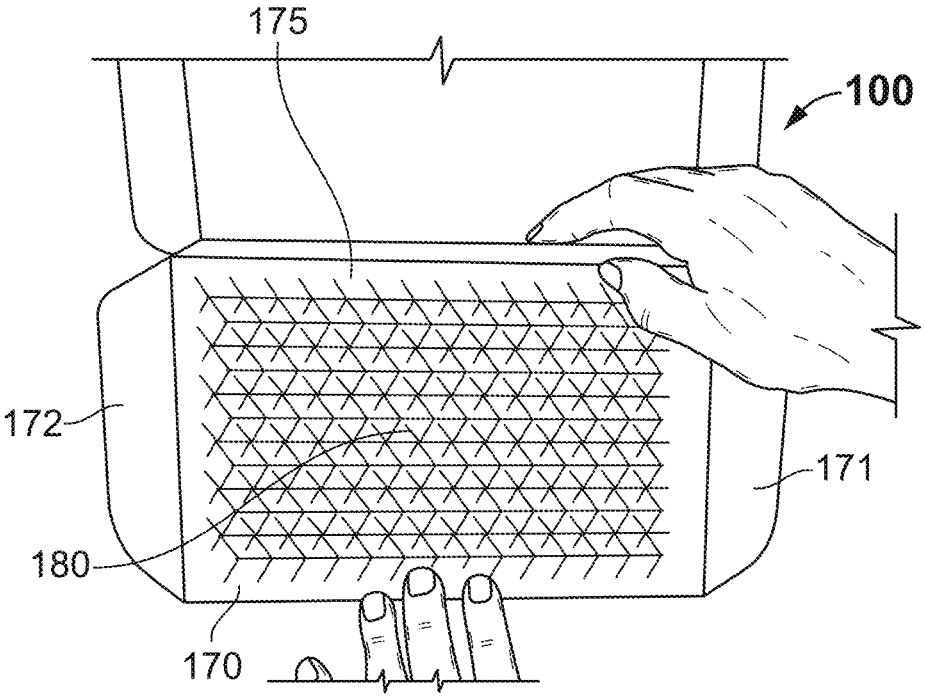
FIG. 4 is a view similar to FIG. 3 but showing the fixative platform panel of the container further assembled.
Figure 5:
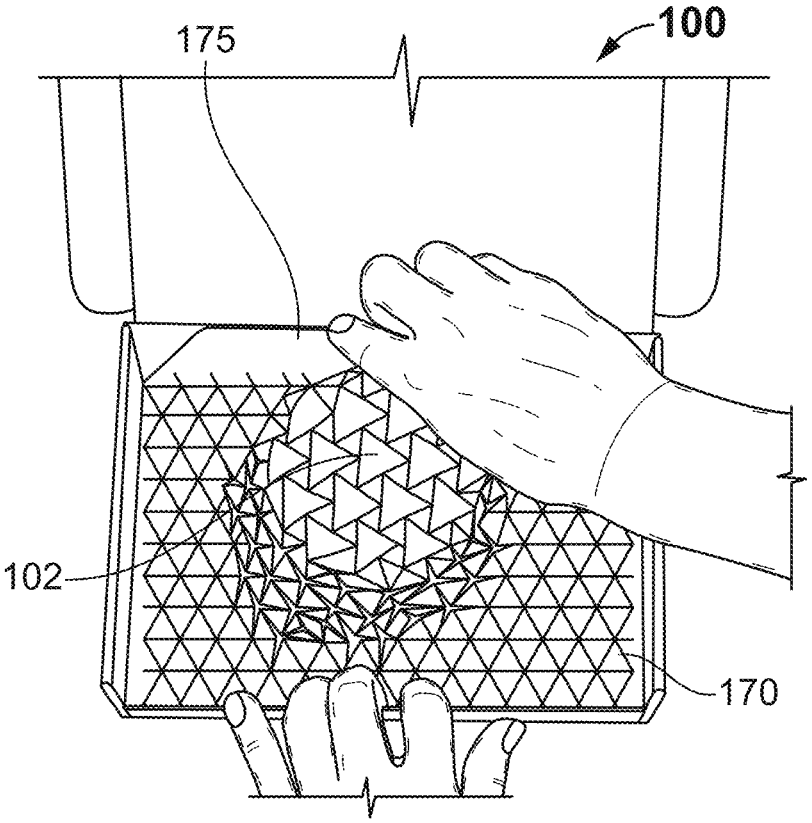
FIG. 5 is a view similar to FIG. 4 but showing the fixative platform panel as further assembled expanding over the object.
Figure 6:
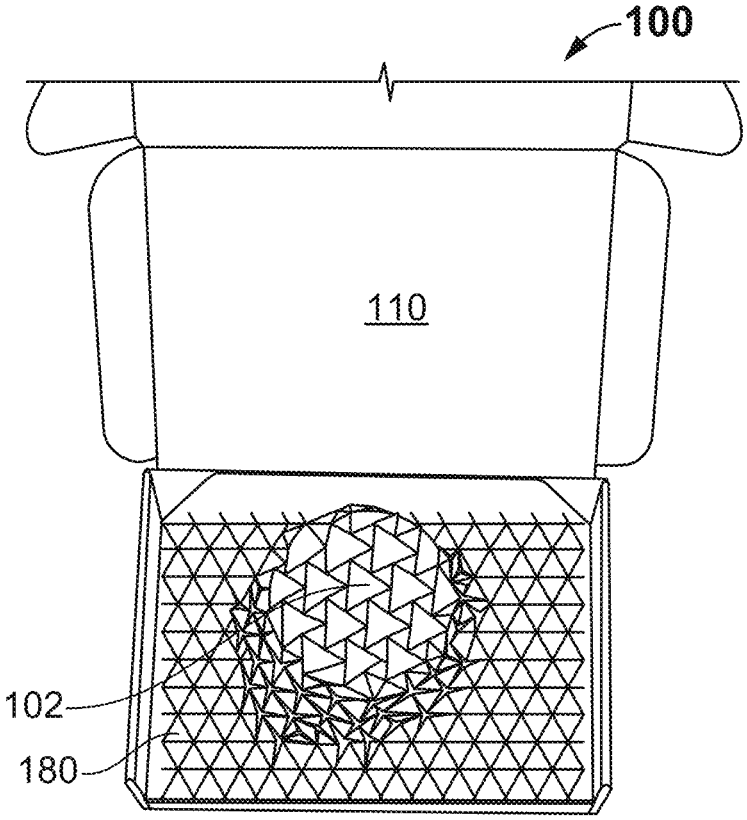
FIG. 6 is a view similar to FIG. 5 but showing the fixative platform panel secured in the container as further assembled.
Figure 7:
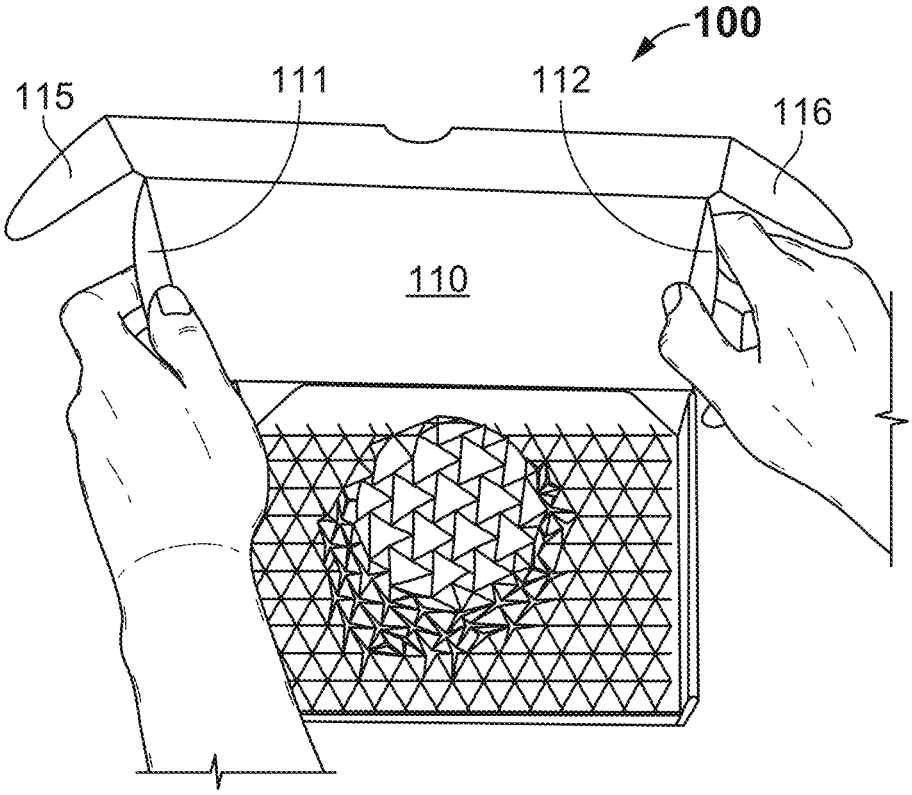
FIG. 7 is a view similar to FIG. 6 but showing folding the top panel side support flap as further assembled.
Figure 8:
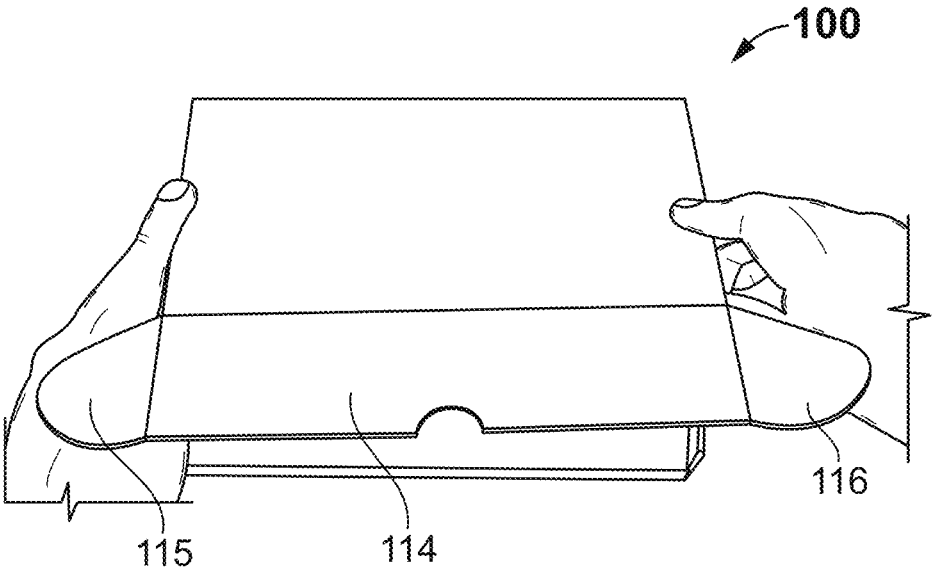
FIG. 8 is a view similar to FIG. 7 but the showing the wrap around end flap as further assembled.
Figure 9:
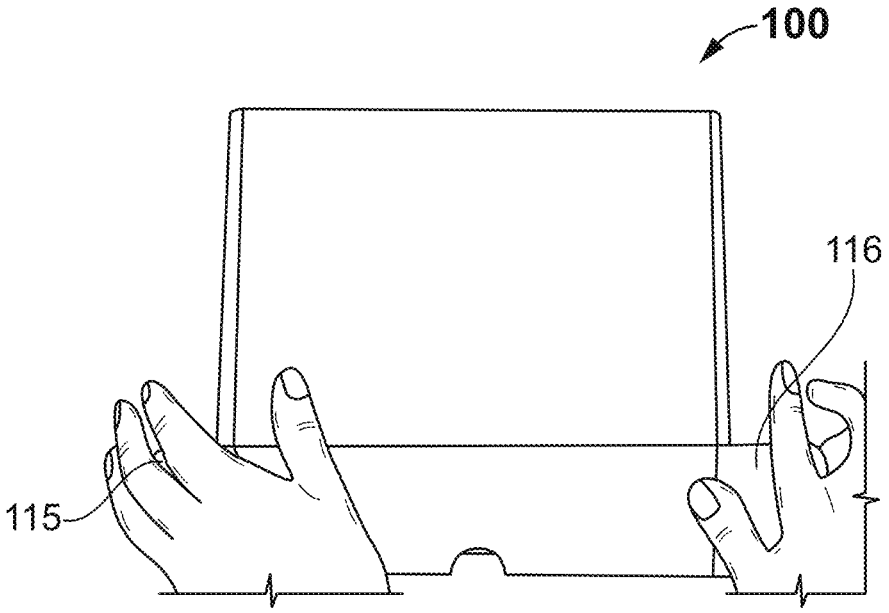
FIG. 9 is a view similar to FIG. 8 but showing the container as further assembled.

In such a manner an object 102 that can fit within the base dimensions of the container 101 can be held by folding the fixative platform panel 170 at perforation 106 line over the object 102 expanding the slit pattern 180 and securing in the container 101 in the held position by placing the protuberance 173 in slot 147 and the protuberance 174 in the slot 158, as shown in FIGS. 4-6. The side platform support flaps 171, 172 and 175 can be folded upwardly and maintain the object in the expanded slit pattern 180 by surfaces the side platform support flaps 171, 172 and 175 engaging the side walls 130, 140, 150 and 160. Alternatively, the side platform support flaps 171, 172 and 175 can be folded downwardly within the container 100 to maintain the platform in a plane at the predetermined height above the bottom panel, thereby holding the object 102 with the expanded the slit pattern 180 with protuberance 173, 174 disposed in the slots 147, 158. In another upwardly folded configuration, including in stacking additional objects using multiple fixative platform panels 170, the side platform support flaps 171, 172 and 175 can be secured by abutting the top panel 120 and side panels 130, 140 and 150, with the perforation 106 providing an additional flexible and/or hinge connection when the container 100 is in the closed position. In an additional manner, the perforation around one or more support flaps 171, 172 and 175 allows the fixative platform panel 170 to be removed, by tearing as desired. Advantageously, a feature of the container 101 is the formed strengthened side wall, e.g. side flaps 131, 132 and side flaps 161, 162 are secured by folding each of side panel 140 and flap 141 securing protrusions 143, 145 in slots 121, 123 as well as folding the side panel 150 and flap 152 securing protrusions 152, 154 in slots 122, 124, respectively. Another advantage of the strengthened side panels 140 and 150 is the ability to receive and maintain the protuberance 173 and 174 in the respective slot 147 and protuberance notch 133 and slot 158 and protuberance notch 134 of a single fixative platform panel 170, and in configurations for stacking additional objects using multiple fixative platform panels 170.

Referring to FIGS. 2-12, according to a method of folding to form erected or otherwise assembled the container 100 of the invention, the top panel 110 is foldably connected the connective side panel 130 due to the combination of cuts 103 adjacent the score line 104, such as made by the machine die cuts 103 during manufacturing to form side support flaps 131, 132. The side support flaps 131, 132 may further be configured with a protuberance notch 133, 134, respectively, such that when folded upwardly the side flap 131 is disposed within the interior of the container 100, as shown in FIG. 1. For example, on one side the protuberance notch 133 features a passthrough for the protuberance 173 of the fixative platform panel 170. Further folding of the side panel 140 upwardly and subsequent folding the flap 141 inwardly over the side flap 131 and adjacent side panel 140 will align the projections 143, 145 align with the slots 121 and 123, respectively, to form a structural side. In addition, the slot 147 will be aligned with protuberance notch 133 to receive the protuberance 173 of the fixative platform panel 170. Similarly, on the other side, further folding of the side panel 150 upwardly and subsequent folding the flap 152 inwardly over the side flap 132 and adjacent side panel 150 will align the projections 152, 154 in the slots 122 and 124, respectively, to form a structural side. Moreover, such further folding of the side panel 150 upwardly and subsequent folding the flap 152 inwardly over the side flap 132 and adjacent side panel 150 will align the protuberance slot 134 slot 158 to receive the protuberance 174 of the fixative platform panel 170.

At about the same time of folding the side flaps 131, 132 inwardly, the side panel 160 is folded upwardly and with the side flaps 161, 162 folding inwardly, each along respective longitudinal and lateral score lines 104 and cuts 103. In this manner, the multiple folds of: upwardly folding of the side panels 130, 140, 150 and 160, the inward folding of the side flaps 131, 132, 161, and 162, and folding of the flap 141 inwardly over the side flaps 131, 161 being ultimately disposed adjacent side panel 140, and having the flap 152 inwardly folded over the side flaps 132, 162 being ultimately disposed adjacent side panel 150 form the structural sides of the container 100. Lastly, a side panel locking feature secures the side panels to provide the structural sides. Specifically, the projections 143, 145 align with the slots 121 and 123, respectively, and are inserted therein, as shown in FIGS. 7-12. and the projections 152, 154 align with the slots 122 and 124 and are inserted therein to lock the folded sides to form the container 100 such that one or more item(s) 102 can be placed stacked within the container 100 in an open position.

While certain configurations of structures have been illustrated for the purposes of presenting the basic structures of the present invention, one of ordinary skill in the art will appreciate that other variations are possible which would still fall within the scope of the appended claims. Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A container formed from a generally planar corrugate board material for containing at least one item, the container comprising:

a blank of the corrugate board cut in a predetermined pattern of connected portions, said predetermined pattern comprising:

a top panel having a pair of side support flaps with a protuberance notch and a wrap around end flap;

a connective side panel having side support flaps with a protuberance notch, said connective side panel being foldably connected to said top panel;

a bottom panel having one or more slots in said bottom panel, said bottom panel being foldably connected to said connective side panel, said bottom panel further being foldably connected to a second and third side panel having a slot, each of the second and third side panels having a flap configured with one or more protrusions, on an outer edge of the blank, said one or more protrusions being adapted to be secured to said one or more slots in said bottom panel when said flaps and said second and third side panels are folded inwardly to the container; and a fourth side panel being foldably connected to the bottom panel, said fourth side panel characterized by a fixative platform panel having an expandable slit pattern, said fixative platform panel comprising one or more side platform support flaps configured with one or more protuberances on an outer edge of the blank.

2. The container of claim 1, further comprising said one or more protuberances being adapted to be secured in said one or more slots in said bottom panel when one or more side platform support flaps are folded upwardly in the container.

3. The container of claim 1, further comprising one or more fixative platform panel can be added to the container, said one or more protuberances being adapted to be secured adjacent each of said protuberance notches within said one or more slots in said second and third side panels when said one or more platform support flaps are folded within the container.

4. The container of claim 1, wherein said wrap around end flap has one or more side tabs.

5. The container of claim 1, wherein said wrap around end flap has at least one adhesive portion.

6. The container of claim 1, wherein the fixative platform panel is foldably connected to by a perforated fold connection to said fourth side panel.

7. The container of claim 1, wherein said slit pattern is a Tessellation pattern configured to be expandable.

* * * * *